US009135922B2

(12) United States Patent
Lee et al.

(10) Patent No.: US 9,135,922 B2
(45) Date of Patent: Sep. 15, 2015

(54) METHOD FOR PROCESSING AUDIO SIGNALS, INVOLVES DETERMINING CODEBOOK INDEX BY SEARCHING FOR CODEBOOK CORRESPONDING TO SHAPE VECTOR GENERATED BY USING LOCATION INFORMATION AND SPECTRAL COEFFICIENTS

(75) Inventors: Changheon Lee, Seoul (KR); Gyuhyeok Jeong, Seoul (KR); Lagyoung Kim, Seoul (KR); Hyejeong Jeon, Seoul (KR); Byungsuk Lee, Seoul (KR); Ingyu Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 252 days.

(21) Appl. No.: 13/817,873

(22) PCT Filed: Aug. 23, 2011

(86) PCT No.: PCT/KR2011/006222

§ 371 (c)(1),
(2), (4) Date: Feb. 20, 2013

(87) PCT Pub. No.: WO2012/026741

PCT Pub. Date: Mar. 1, 2012

(65) Prior Publication Data

US 2013/0151263 A1 Jun. 13, 2013

Related U.S. Application Data

(60) Provisional application No. 61/376,667, filed on Aug. 24, 2010.

(51) Int. Cl.
*G10L 19/008* (2013.01)
*G10L 19/02* (2013.01)

(Continued)

(52) U.S. Cl.
CPC ..... *G10L 19/008* (2013.01); *G10L 19/02* (2013.01); *G10L 19/038* (2013.01); *G10L 19/04* (2013.01); *G10L 2019/0005* (2013.01)

(58) Field of Classification Search
None
See application file for complete search history.

(56) References Cited

U.S. PATENT DOCUMENTS 6,658,382 B1 12/2003 Iwakami et al.
6,826,526 B1 11/2004 Norimatsu et al.

(Continued)

FOREIGN PATENT DOCUMENTS

CN 101548316 A 9/2009
EP 0910067 A1 4/1999

(Continued)

OTHER PUBLICATIONS

European Search Report dated Dec. 6, 2013 for Application No. 11820168.0, 5 pages.

(Continued)

*Primary Examiner* — Vincent Rudolph
*Assistant Examiner* — Richa Mishra
(74) *Attorney, Agent, or Firm* — Fish & Richardson P.C.

(57) ABSTRACT

The present invention provides a method for processing audio signals, and the method comprises the steps of: receiving input audio signals corresponding to a plurality of spectral coefficients; obtaining location information that indicates a location of a particular spectral coefficient among said spectral coefficients, on the basis of energy of said input signals: generating a shape vector by using said location information and said spectral coefficients; determining a codebook index by searching for a codebook corresponding to said shape vector; and transmitting said codebook index and said location information, wherein said shape vector is generated by using a part which is selected from said spectral coefficients, and said selected part is selected on the basis of said location information.

10 Claims, 11 Drawing Sheets

(51) Int. Cl.

| | |
|---|---|
| ***G10L 19/038*** | (2013.01) |
| *G10L 19/04* | (2013.01) |
| *G10L 19/00* | (2013.01) |

(56) References Cited

U.S. PATENT DOCUMENTS

| | | | | |
|---|---|---|---|---|
| 6,871,106 | B1 | 3/2005 | Ishikawa et al. | |
| 6,904,404 | B1 | 6/2005 | Norimatsu et al. | |
| 7,243,061 | B2 | 7/2007 | Norimatsu et al. | |
| 8,352,258 | B2 | 1/2013 | Yamanashi | |
| 2005/0060147 | A1 * | 3/2005 | Norimatsu et al. | 704/230 |
| 2009/0083046 | A1 | 3/2009 | Mehrotra et al. | |
| 2010/0057446 | A1 * | 3/2010 | Morii et al. | 704/205 |
| 2010/0169081 | A1 * | 7/2010 | Yamanashi et al. | 704/203 |

FOREIGN PATENT DOCUMENTS

| | | | |
|---|---|---|---|
| EP | 0919989 | A1 | 6/1999 |
| EP | 0942411 | A2 | 9/1999 |
| EP | 942411 | A2 * | 9/1999 |
| EP | 1047047 | A2 | 10/2000 |
| EP | 0910067 | B1 | 8/2003 |
| EP | 0942411 | B1 | 3/2004 |
| EP | 1047047 | B1 | 2/2005 |
| EP | 2 101 318 | A1 | 9/2009 |
| JP | 11-030998 | A | 2/1999 |
| JP | 11-330977 | A | 11/1999 |
| JP | 2000-338998 | A | 12/2000 |
| WO | WO 98/00837 | A1 | 1/1998 |
| WO | WO 98/52188 | A1 | 11/1998 |

OTHER PUBLICATIONS

International Search Report dated Feb. 21, 2012 for Application No. PCT/KR2011/006222, with English Translation, 6 pages.

Chinese Office Action dated Jan. 28, 2014 for Application No. 2011-80041093 with English Translation, 13 pages.

* cited by examiner

M = 4

FIG. 7

| | Syntax elements | m=0 | m=1 | m=2 | m=3 |
|---|---|---|---|---|---|
| a | Location information($K_m$) | m=0 | m=1 | m=2 | m=3 |
| b | Sign information($Sign_m$) | m=0 | m=1 | m=2 | m=3 |
| c | Codebook index($Y_{mi}$) of shape vector($S_m$) | m=0 | m=1 | m=2 | m=3 |
| d | Normalized value mean($G_{mean}$) | 5 | | | |
| e | Normalized value index(Gi) | 6 | | | |
| | | j=0 | j=1 | j=2 | j=3 |
| f | Envelope parameter index($F_{ji}$) | 5 | 5 | 5 | 5 |
| g | Mean energy($M_F$) | 5 | | | |
| Total bit number | | 80 | | | |

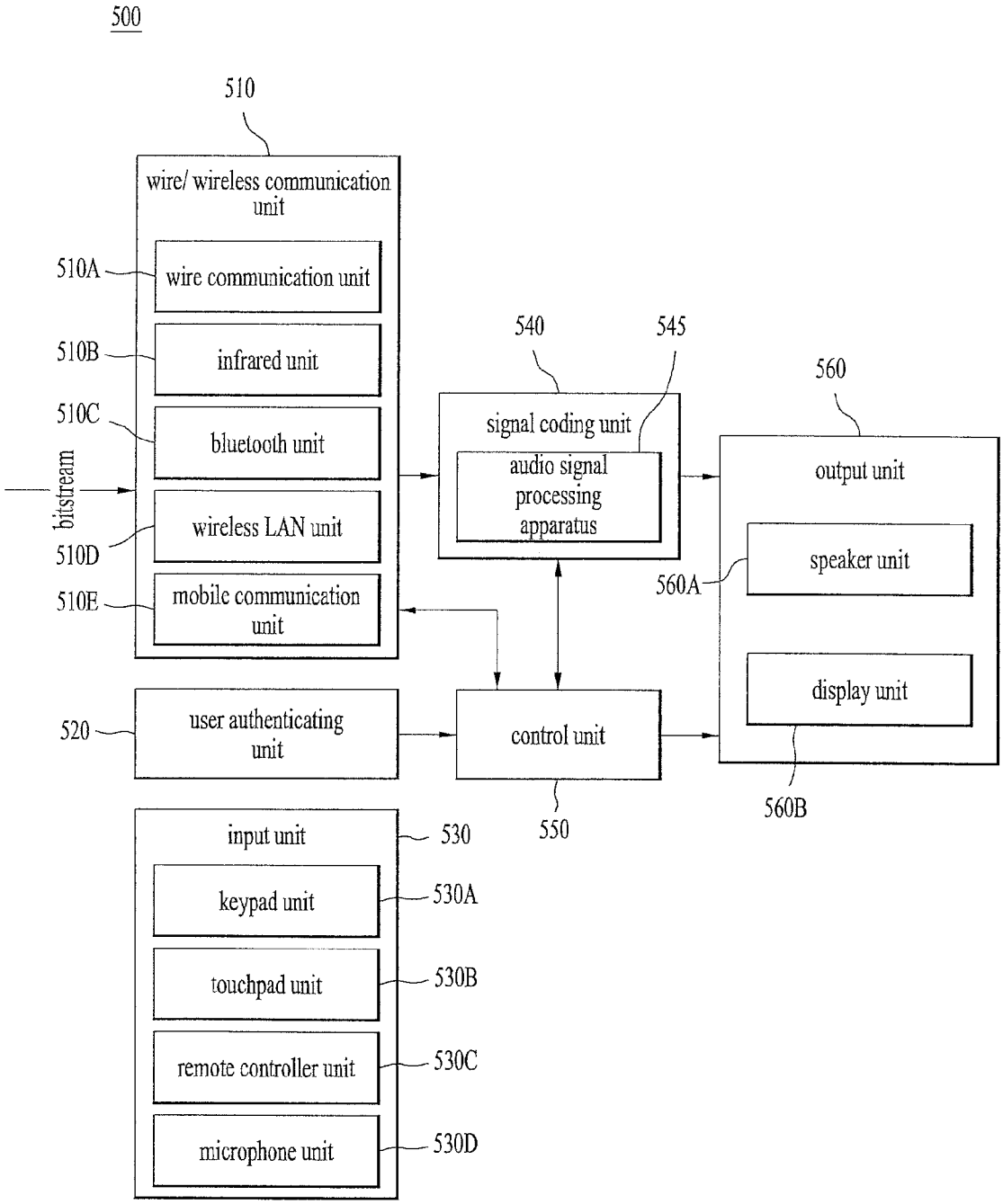
500
510
wire/ wireless communication unit
510A
wire communication unit
510B
infrared unit
510C
bluetooth unit
bitstream
510D
wireless LAN unit
510E
mobile communication unit
540
545
signal coding unit
audio signal processing apparatus
560
output unit
speaker unit
560A
display unit
560B
520
user authenticating unit
control unit
550
input unit
530
keypad unit
530A
touchpad unit
530B
remote controller unit
530C
microphone unit
530D

METHOD FOR PROCESSING AUDIO SIGNALS, INVOLVES DETERMINING CODEBOOK INDEX BY SEARCHING FOR CODEBOOK CORRESPONDING TO SHAPE VECTOR GENERATED BY USING LOCATION INFORMATION AND SPECTRAL COEFFICIENTS

CROSS REFERENCE TO RELATED APPLICATIONS

This application is a U.S. National Phase Application under 35 U.S.C. §371 of International Application PCT/KR2011/006222, filed on Aug. 23, 2011, which claims the benefit of U.S. Provisional Application No. 61/376,667, filed on Aug. 24, 2010, the entire contents of which are hereby incorporated by reference in their entireties.

TECHNICAL FIELD

The present invention relates to an apparatus for processing an audio signal and method thereof. Although the present invention is suitable for a wide scope of applications, it is particularly suitable for encoding or decoding an audio signal.

BACKGROUND ART

Generally, it may be able to perform a frequency transform (e.g., MDCT (modified discrete cosine transform)) on an audio signal. In doing so, an MDCT coefficient as a result of the MDCT is transmitted to a decoder. If so, the decoder reconstructs the audio signal by performing a frequency inverse transform (e.g., iMDCT (inverse MDCT)) using the MDCT coefficient.

DISCLOSURE OF THE INVENTION

Technical Problem

However, in the course of transmitting the MDCT coefficient, if all data are transmitted, it may cause a problem that bit rate efficiency is lowered. In case that such data as a pulse and the like is transmitted, it may cause a problem that a reconstruction rate is lowered.

Technical Solution

Accordingly, the present invention is directed to substantially obviate one or more of the problems due to limitations and disadvantages of the related art. An object of the present invention is to provide an apparatus for processing an audio signal and method thereof, by which a shape vector generated on the basis of energy can be used to transmit a spectral coefficient (e.g., MDCT coefficient).

Another object of the present invention is to provide an apparatus for processing an audio signal and method thereof, by which a shape vector is normalized and then transmitted to reduce a dynamic range in transmitting a shape vector.

A further object of the present invention is to provide an apparatus for processing an audio signal and method thereof, by which in transmitting a plurality of normalized values generated per step, vector quantization is performed on the rest of the values except an average of the values.

Advantageous Effects

Accordingly, the present invention provides the following effects and/or features.

First of all, in transmitting a spectral coefficient, as a shape vector generated on the basis of energy is transmitted, it may be able to raise a reconstruction rate with a relatively small number of bits.

Secondly, since a shape vector is normalized and then transmitted, the present invention reduces a dynamic range, thereby raising bit efficiency.

Thirdly, the present invention transmits a plurality of shape vectors by repeating a shape vector generating step in multi-stages, thereby reconstructing a spectral coefficient more accurately without raising a bitrate considerably.

Fourthly, in transmitting a normalized value, the present invention separately transmits an average of a plurality of normalized values and vector-quantizes a value corresponding to a differential vector only, thereby raising bit efficiency.

Fifthly, a result of vector quantization performed on the normalized value differential vector almost has no correlation to SNR and the total number of bits assigned to a differential vector but has high correlation to the total bit number of a shape vector. Hence, although a relatively smaller number of bits are assigned to the normalized value differential vector, it is advantageous in not causing considerable trouble to a reconstruction rate.

DESCRIPTION OF DRAWINGS

FIG. 7 is a diagram for one example of a syntax for elements included in a bitstream.

FIG. 9 is a schematic block diagram of a product in which an audio signal processing apparatus according to one embodiment of the present invention is implemented;

BEST MODE

Figure 1:
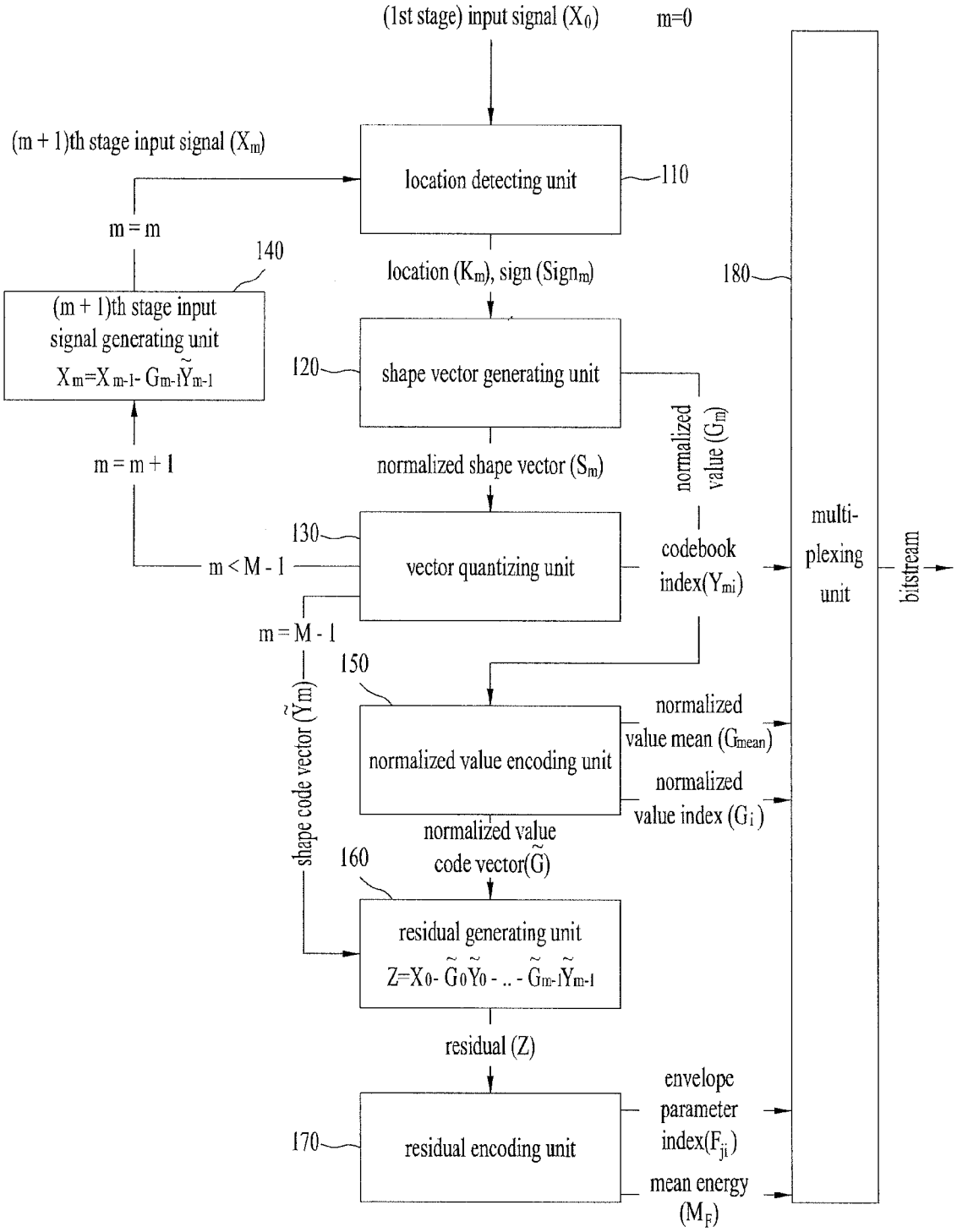
FIG. 1 is a block diagram of an audio signal processing apparatus according to an embodiment of the present invention.

To achieve these and other advantages and in accordance with the purpose of the present invention, as embodied and broadly described, a method of processing an audio signal according to one embodiment of the present invention may include the steps of receiving an input audio signal corresponding to a plurality of spectral coefficients, obtaining a location information indicating a location of a specific one of a plurality of the spectral coefficients based on energy of the input signal, generating a shape vector using the location information and the spectral coefficients, determining a codebook index by searching a codebook corresponding to the shape vector, and transmitting the codebook index and the location information, wherein the shape vector is generated using a part selected from the spectral coefficients and wherein the selected part is selected based on the location information.

According to the present invention, the method may further include the steps of generating a sign information on the specific spectral coefficient and transmitting the sign information, wherein the shape vector is generated further based on the sign information.

According to the present invention, the method may further include the step of generating a normalized value for the selected part. The codebook index determining step may include the steps of generating a normalized shape vector by normalizing the shape vector using the normalized value and determining the codebook index by searching the codebook corresponding to the normalized shape vector.

According to the present invention, the method may further include the steps of calculating a mean of $1^{st}$ to $M^{th}$ stage normalized values, generating a differential vector using a value resulting from subtracting the mean from the $1^{st}$ to $M^{th}$ stage normalized values, determining the normalized value index by searching the codebook corresponding to the differential vector, and transmitting the mean and the normalized index corresponding to the normalized value.

According to the present invention, the input audio signal may include an $(m+1)^{th}$ stage input signal, the shape vector may include an $(m+1)^{th}$ stage shape vector, the normalized value may include an $(m+1)^{th}$ stage normalized value, and the $(m+1)^{th}$ stage input signal may be generated based on an $m^{th}$ stage input signal, an $m^{th}$ stage shape vector and an $m^{th}$ stage normalized value.

According to the present invention, the codebook index determining step may include the steps of searching the codebook using a cost function including a weight factor and the shape vector and determining the codebook index corresponding to the shape vector and the weight factor may vary in accordance with the selected part.

According to the present invention, the method may further include the steps of generating a residual signal using the input audio signal and a shape code vector corresponding to the codebook index and generating an envelope parameter index by performing a frequency envelope coding on the residual signal.

To further achieve these and other advantages and in accordance with the purpose of the present invention, an apparatus for processing an audio signal according to another embodiment of the present invention may include a location detecting unit receiving an input audio signal corresponding to a plurality of spectral coefficients, the location detecting unit obtaining a location information indicating a location of a specific one of a plurality of the spectral coefficients based on energy of the input signal, a shape vector generating unit generating a shape vector using the location information and the spectral coefficients, a vector quantizing unit determining a codebook index by searching a codebook corresponding to the shape vector, and a multiplexing unit transmitting the codebook index and the location information, wherein the shape vector is generated using a part selected from the spectral coefficients and wherein the selected part is selected based on the location information.

According to the present invention, the location detecting unit may generate a sign information on the specific spectral coefficient, the multiplexing unit may transmit the sign information, and the shape vector may be generated further based on the sign information.

According to the present invention, the shape vector generating unit may further generate a normalized value for the selected part and generate a normalized shape vector by normalizing the shape vector using the normalized value. And, the vector quantizing unit may determine the codebook index by searching the codebook corresponding to the normalized shape vector.

According to the present invention, the apparatus may further include a normalized value encoding unit calculating a mean of $1^{st}$ to $M^{th}$ stage normalized values, the normalized value encoding unit generate a differential vector using a value resulting from subtracting the mean from the $1^{st}$ to $M^{th}$ stage normalized values, the normalized value encoding unit determining the normalized value index by searching the codebook corresponding to the differential vector, the normalized value encoding unit transmitting the mean and the normalized index corresponding to the normalized value.

According to the present invention, the input audio signal may include an $(m+1)^{th}$ stage input signal, the shape vector may include an $(m+1)^{th}$ stage shape vector, the normalized value may include an $(m+1)^{th}$ stage normalized value, and the $(m+1)^{th}$ stage input signal may be generated based on an $m^{th}$ stage input signal, an $m^{th}$ stage shape vector and an $m^{th}$ stage normalized value.

According to the present invention, the vector quantizing unit may search the codebook using a cost function including a weight factor and the shape vector and determine the codebook index corresponding to the shape vector. And, the weight factor may vary in accordance with the selected part.

According to the present invention, the apparatus may further include a residual encoding unit generating a residual signal using the input audio signal and a shape code vector corresponding to the codebook index, the residual encoding unit generating an envelope parameter index by performing a frequency envelope coding on the residual signal.

MODE FOR INVENTION

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

According to the present invention, the following terminologies may be construed in accordance with the following references and other terminologies not disclosed in this specification can be construed as the following meanings and concepts matching the technical idea of the present invention. Specifically, 'coding' can be construed as 'encoding' or 'decoding' selectively and 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and designates all kinds of signals that can be auditorily identified. In a narrow sense, the audio signal means a signal having none or small quantity of speech characteristics. Audio signal of the present invention should be construed in a broad sense. Yet, the audio signal of the present invention can be understood as an audio signal in a narrow sense in case of being used as discriminated from a speech signal.

Although coding is specified to encoding only, it can be also construed as including both encoding and decoding.

FIG. 1 is a block diagram of an audio signal processing apparatus according to an embodiment of the present invention. Referring to FIG. 1, an encoder 100 includes a location detecting unit 110 and a shape vector generating unit 120. The encoder 100 may further include at least one of a vector quantizing unit 130, an $(m+1)^{th}$ stage input signal generating unit 140, a normalized value encoding unit 150, a residual generating unit 160, a residual encoding unit 170 and a multiplexing unit 180. The encoder 100 may further include a transform unit (not shown in the drawing) configured to generate a spectral coefficient or may receive a spectral coefficient from an external device.

In the following description, functions of the above components are schematically explained. First of all, spectral coefficients of the encoder 100 are received or generated, a location of a high energy sample is detected from the spectral coefficients, a normalized shape vector is generated based on the detected location, normalization is performed, and vector quantization is then performed. Generation, normalization and vector quantization of a shape vector are repeatedly performed on signal in subsequent stages (m=1, . . . , M−1). Encoding is performed on a plurality of the normalized values generated by the multiple stages, a residual for the encoding result is generated via the shape vector, and residual coding is then performed on the generated residual.

In the following description, the functions of the above components shall be explained in detail.

First of all, the location detecting unit 110 receives spectral coefficients as an input signal $X_0$ (of a $1^{st}$ stage (m=0)) and then detects a location of the coefficient having a maximum sample energy from the coefficients. In this case, the spectral coefficient corresponds to a result of frequency transform of an audio signal of a single frame (e.g., 20 ms). For instance, if the frequency transform includes MDCT, the corresponding result may include MDCT (modified discrete cosine transform coefficient. Moreover, it may correspond to an MDCT coefficient constructed with frequency components on low frequency band (4 kHz or lower).

The input signal $X_0$ of the $1^{st}$ stage (m=0) is a set of total N spectral coefficients and may be represented as follows.

$$X_0=[x_0(0),x_0(1), \ldots x_0(N-1)] \quad \text{[Formula 1]}$$

In Formula 1, $X_0$ indicates an input signal of a $1^{st}$ stage (m=0) and N indicates the total number of spectral coefficients.

The location detecting unit 110 determines a frequency (or a frequency location) km corresponding to a coefficient having a maximum sample energy for the input signal $X_0$ of the $1^{st}$ stage (m=0) as follows.

$$k_m = \underset{0 \le n < N}{\operatorname{argmax}}(|x_m(n)|) \quad \text{[Formula 2]}$$

In Formula 2, $X_m$ indicates the $(m+1)^{th}$ stage input signal (spectral coefficient), n indicates an index of a coefficient, N indicates the total number of coefficients of an input signal, and $k_m$ indicates a frequency (or location) corresponding to a coefficient having a maximum sample energy.

Meanwhile, if the m is not 0 but is equal to or greater than 1 (i.e., a case of an input signal of a $(m+1)^{th}$ stage), an output of the $(m+1)^{th}$ stage input signal generating unit 150 is inputted to the location detecting unit 110 instead of the input signal $X_0$ of the $1^{st}$ stage (m=0), which shall be explained in the description of the $(m+1)^{th}$ stage input signal generating unit 150.

Figure 2:
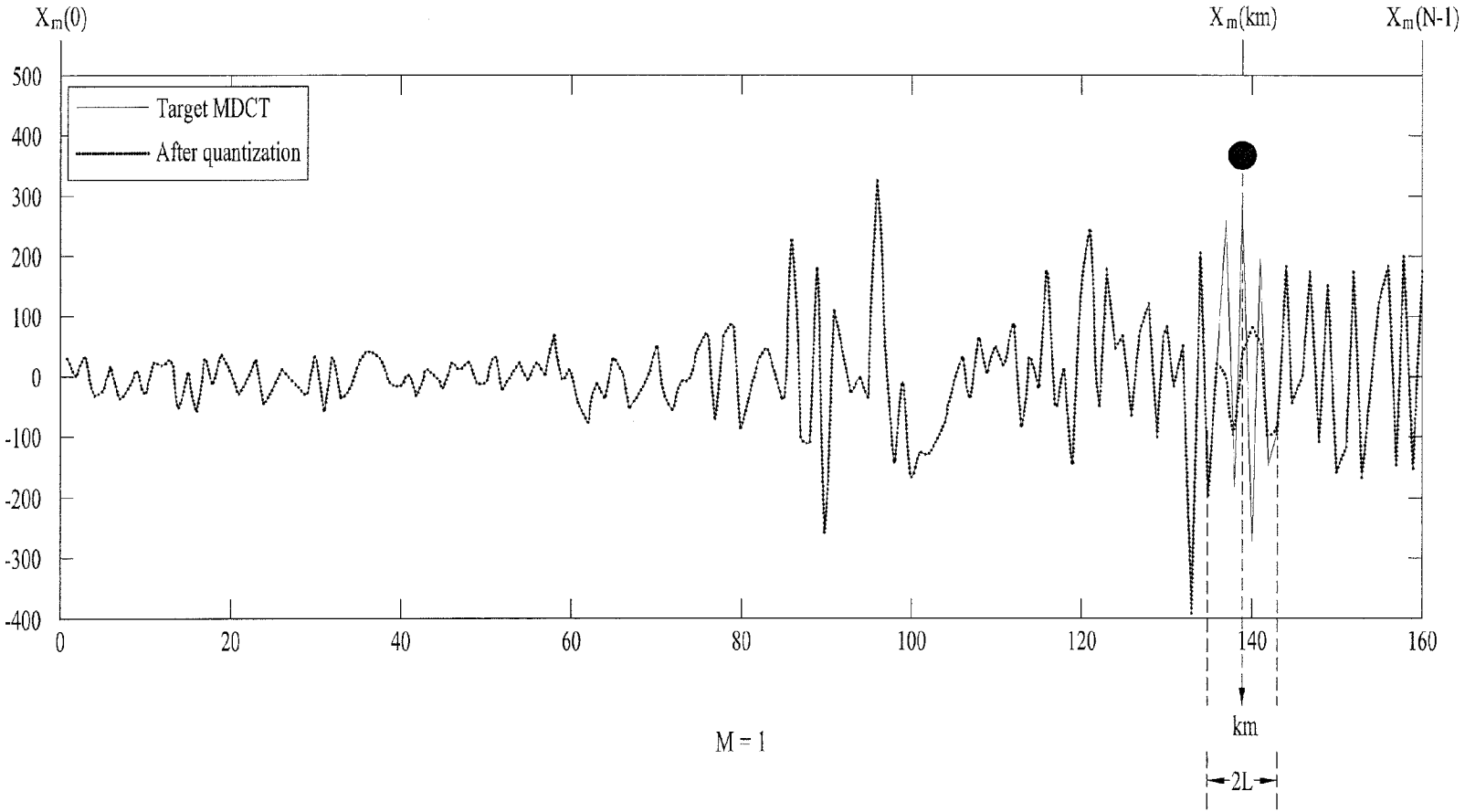
FIG. 2 is a diagram for describing a process for generating a shape vector.

In FIG. 2, one example of spectral coefficients $X_m(0)$~$X_m(N-1)$, of which total number N is about 160, is illustrated. Referring to FIG. 2, a value of a coefficient $X_m(k_m)$ having a highest energy corresponds to about 450. And, a frequency or location Km corresponding to this coefficient is nearby n (=140) (about 139).

Thus, once the location ($k_m$) is detected, a sign (Sign($X_m(K_m)$)) of a coefficient $X_m(k_m)$ corresponding to the location $k_m$ is generated. This sign is generated to make shape vectors have positive (+) values in the future.

As mentioned in the above description, the location detecting unit 110 generates the location $k_m$ and the sign Sign($X_m(k_m)$) and then forwards them to the shape vector generating unit 120 and the multiplexing unit 190.

Based on the input signal $X_m$, the received location $k_m$ and the sign Sign($X_m(k_m)$), the shape vector generating unit 120 generates a normalized shape vector $S_m$ in 2L dimensions.

$$\begin{aligned} S_m &= [x_m(k_m - L + 1), \ldots, x_m(k_m), \ldots, x_m(k_m + L)] \cdot \\ &\quad \operatorname{sign}(x_k(k_m)) / G_n \\ &= (s_m(0), s_m(1), \ldots, s_m(2L-1)] \end{aligned} \quad \text{[Formula 3]}$$

$$S_m = [S_m(n)] \ (n = 0 \sim 2L\text{-}1)$$

In Formula 3, $S_m$ indicates a normalized shape vector of $(m+1)^{th}$ stage, n indicates an element index of a shape vector, L indicates dimension, $k_m$ indicates a location ($k_m$=0~N−1) of a coefficient having a maximum energy in the $(m+1)^{th}$ stage input signal, Sign($X_m(k_m)$) indicates a sign of a coefficient having a maximum energy, '$X_m(k_m-L+1)$, $X_m(k_m+L)$' indicate portions selected from spectral coefficients based on the location $k_m$, and $G_m$ indicates a normalized value.

The normalized value $G_m$ may be defined as follows.

$$G_m = \sqrt{\frac{1}{2L} \sum_{l=-L+1}^{L} x_m^2(k_m + l)} \quad \text{[Formula 4]}$$

In Formula 4, $G_m$ indicates a normalized value, $X_m$ indicates an $(m+1)^{th}$ stage input signal, and L indicates dimension.

In particular, the normalized value can be calculated into an RMS (root mean square) value expressed as Formula 4.

Referring to FIG. 2, since a shape vector $S_m$ corresponds to a set of total 2L coefficients on the right and lefts sides centering on the $k_m$, if L=10, 10 coefficients are located on each of the right and left sides centering on a point '139'. Hence, the shape vector $S_m$ may correspond to a set of the coefficients ($X_m(130)$, . . . , $X_m(149)$) having 'n=130~149'.

Meanwhile, as multiplied by the Sign($X_m(k_m)$) in Formula 3, a sign of a maximum peak component becomes identical to a positive (+) value. If a shape vector is normalized into an RMS value by equalizing a location and sign of the shape vector, it is able to further raise quantization efficiency using a codebook.

The shape vector generating unit 120 delivers the normalized shape vector $S_m$ of the $(m+1)^{th}$ stage to the vector quantizing unit 130 and also delivers the normalized value $G_m$ to the normalized value encoding unit 150.

The vector quantizing unit 130 vector-quantizes the quantized shape vector $S_m$. In particular, the vector quantizing unit 130 selects a code vector $\tilde{Y}_m$ most similar to the normalized shape vector $S_m$ from code vectors included in a codebook by searching the codebook, delivers the code vector $\tilde{Y}_m$ to the $(m+1)^{th}$ stage input signal generating unit 140 and the residual generating unit 160, and also delivers a codebook index $Y_{mi}$ corresponding to the selected code vector $\tilde{Y}_m$ to the multiplexing unit 180.

Figure 4:
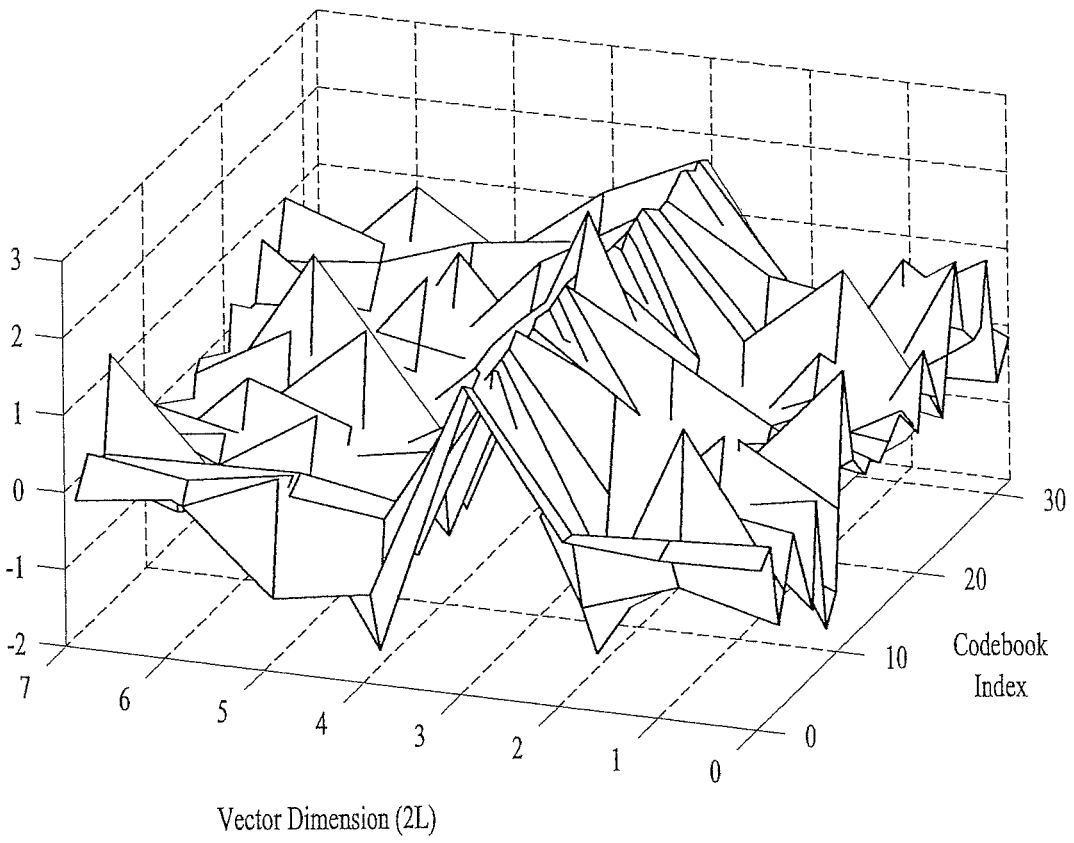
FIG. 4 shows one example of a codebook necessary for vector quantization of a shape vector.

One example of the codebook is shown in FIG. 4. Referring to FIG. 4, after 8-dimensional shape vectors corresponding to 'L=4' have been extracted, a 5-bit vector quantization codebook is generated through a training process. According to the diagram, it can be observed that peak locations and signs of the code vectors configuring the codebook are equally arranged.

Meanwhile, before searching the codebook, the vector quantizing unit 130 defines a cost function as follows.

$$D(i) = \sum_{n=0}^{2L-1} w_m(n)(s_m(n) - c(i, n))^2 \quad \text{[Formula 5]}$$

In Formula 5, i indicates a codebook index, D(i) indicates a cost function, n indicates an element index of a shape vector, $S_m(n)$ indicates an nth element of an $(m+1)^{th}$ stage, c(i, n) indicates an $n^{th}$ element in a code vector having a codebook index set to i, and $W_m$ (n) indicates a weight function.

Figure 6:
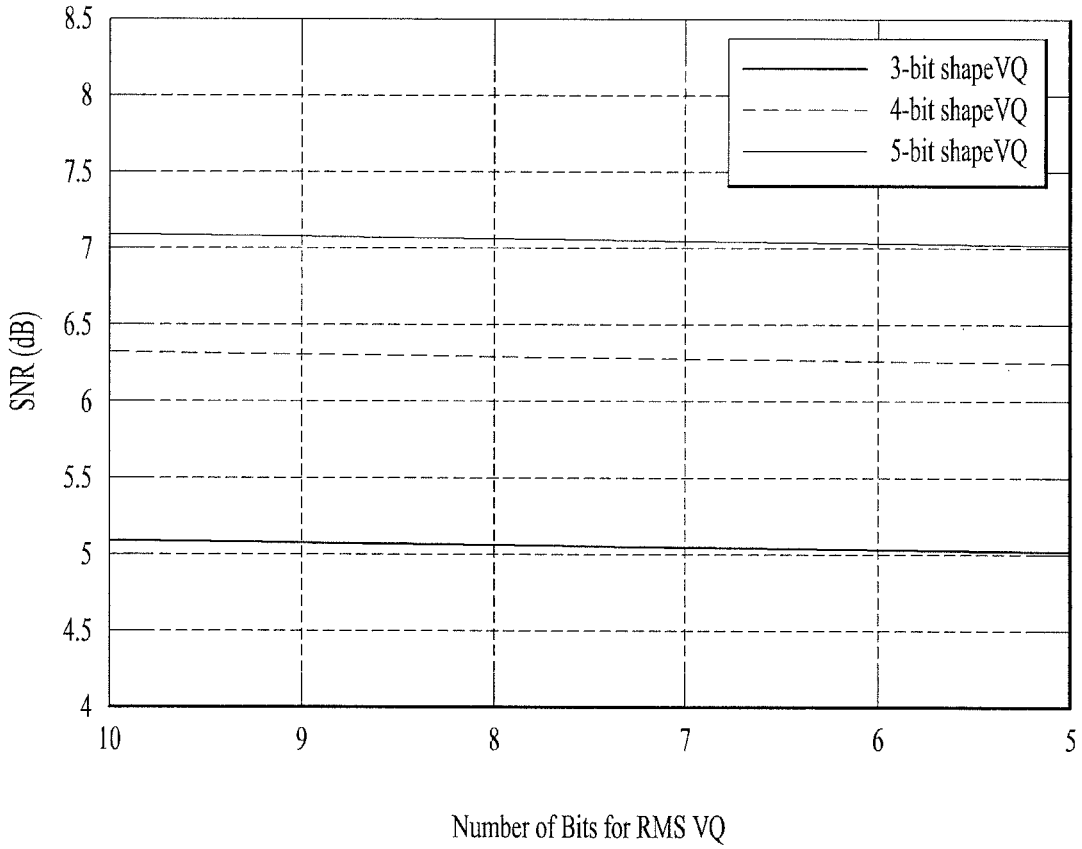
FIG. 6 is a diagram for a relation between the total bit number of a normalized value differential code vector and a signal to noise ratio (SNR).

The weight factor $W_m$ (n) may be defined as follows.

$$w_m(n) = |s_m(n)| \Big/ \sqrt{\sum_{n=0}^{2L-1} s_m^2(n)} \quad \text{[FIG. 6]}$$

In FIG. 6, $W_m$ (n) indicates a weight vector, n indicates an element index of a shape vector, $S_m(n)$ indicates an $n^{th}$ element of a shape vector in an $(m+1)^{th}$ stage. In this case, the weight vector varies in accordance with a shape vector $S_m(n)$ or a selected part $(X_m(k_m-L+1), \ldots, X_m(k_m+L))$.

The cost function is defined as Formula 5 and a search for a code vector $C_i$=[c(i, 0), c(i, 1), . . . , c(i, 2L−1)] that minimizes the cost function. In doing so, a weight vector $W_m(n)$ is applied to an error value for an element of a spectral coefficient. This means an energy ratio occupied by the element of each spectral coefficient in a shape vector and may be defined as Formula 6. In particular, in searching for a code vector, in a manner of raising significance for spectral coefficient elements having relatively high energy, it is able to further enhance quantization performance on the corresponding elements.

Figure 5:
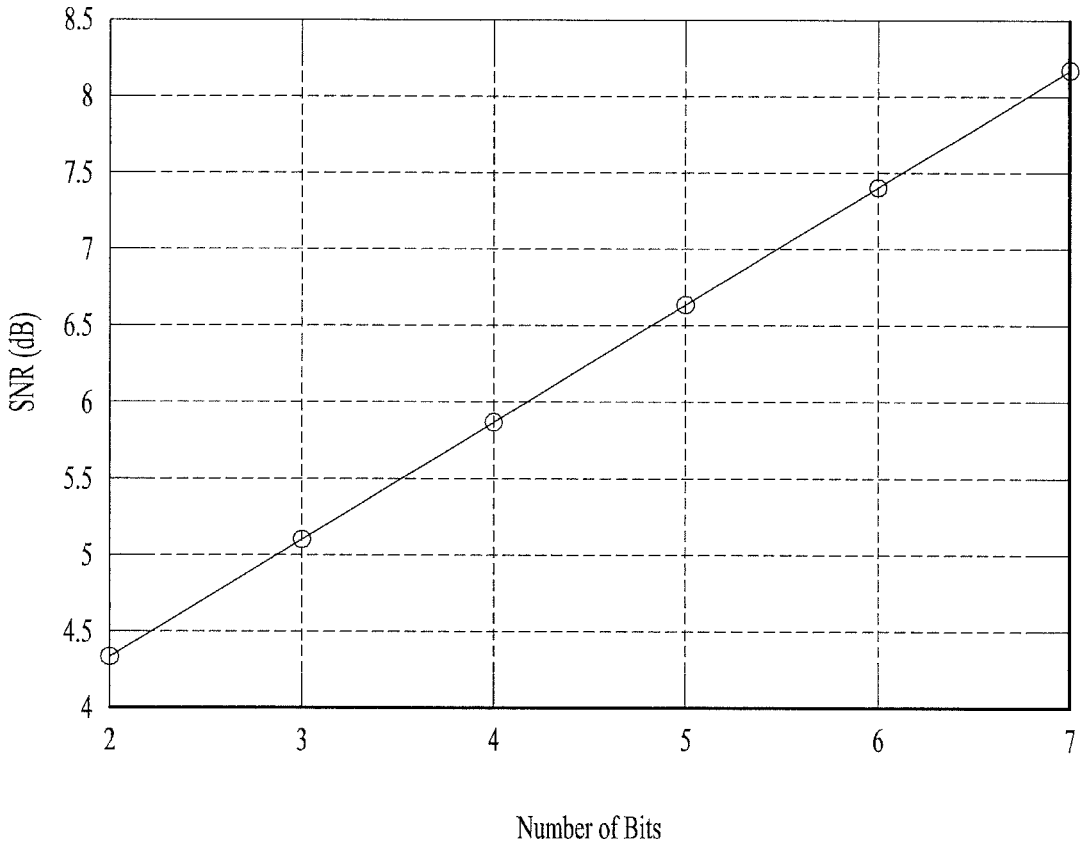
FIG. 5 is a diagram for a relation between the total bit number of a shape vector and a signal to noise ratio (SNR).

FIG. 5 is a diagram for a relation between the total bit number of a shape vector and a signal to noise ratio (SNR). After vector quantization has performed on a shape vector by generating 2-bit codebook to 7-bit codebook, if a signal to noise ratio is measured through an error from an original signal, referring to FIG. 5, it is able to confirm that the SNR increases by about 0.8 dB when 1 bit is increased.

Consequently, a code vector Ci, which minimizes the cost function of Formula 5, is determined as a code vector $\tilde{Y}_m$ (or a shoe code vector) of a shape vector and a codebook index I is determined as a codebook index $Y_{mi}$ of the shape vector. As mentioned in the foregoing description, the codebook index $Y_{mi}$ is delivered to the multiplexing unit 180 as a result of the vector quantization. The shape code vector $\tilde{Y}_m$ is delivered to the $(m+1)^{th}$ stage input signal generating unit 140 for generation of an $(m+1)^{th}$ stage input signal and is delivered to the residual generating unit 160 for residual generation.

Meanwhile, for the $1^{st}$ stage input signal ($X_m$, m=0), the location detecting unit 110 or the vector quantizing unit 130 generates a shape vector and then performs vector quantization on the generated shape vector. If m<(M−1), the $(m+1)^{th}$ stage input signal generating unit 140 is activated and then performs the shape vector generation and the vector quantization on the $(m+1)^{th}$ stage input signal. On the other hand, if m=M, the $(m+1)^{th}$ stage input signal generating unit 140 is not activated but the normalized value encoding unit 150 and the residual generating unit 160 become active. In particular, if M=4, the $(m+1)^{th}$ stage input signal generating unit 140, the location detecting unit 110 and the vector quantizing unit 130 repeatedly perform the operations on $2^{nd}$ to $4^{th}$ stage input signals in case of 'm=1, 2 and 3' after 'm=0 (i.e., $1^{st}$ stage input signal)'. So to speak, if m=0~3, after completion of the operations of the components 110, 120, 130 and 140, the normalized value encoding unit 150 and the residual generating unit 160 become active.

Before the $(m+1)^{th}$ stage input signal generating unit 140 becomes active, an operation 'm=m+1' is performed. In particular, if m=0, the $(m+1)^{th}$ stage input signal generating unit 140 operated for the case of 'm=1'. The $(m+1)^{th}$ stage input signal generating unit 140 generates an $(m+1)^{th}$ stage input signal by the following formula.

$$X_m = X_{m-1} - G_{m-1}\tilde{Y}_{m-1} \quad \text{[Formula 7]}$$

In Formula 7, $X_m$ indicates an $(m+1)^{th}$ stage input signal, $X_{m-1}$ indicates an $(m+1)^{th}$ stage input signal, $G_{m-1}$ indicates an $m^{th}$ stage normalized value, and $\tilde{Y}_{m-1}$ indicates an $m^{th}$ stage shape code vector.

The $2^{nd}$ stage input signal $X_1$ is generated using the $1^{st}$ stage input signal $X_0$, the $1^{st}$ stage normalized value $G_0$ and the $1^{st}$ stage shape code vector $\tilde{Y}_0$.

Meanwhile, the $m^{th}$ stage shape code vector $\tilde{Y}_{m-1}$ is the vector having the same dimension(s) of $X_m$ rather than the aforementioned shape code vector $\tilde{Y}_m$ and corresponds to a vector configured in a manner that right and left parts (N−2L) centering on a location $k_m$ are padded with zeros. A sign ($Sign_m$) should be applied to the shape code vector as well.

The above-generated $(m+1)^{th}$ stage input signal $X_m$ (where m=m) is inputted to the location detecting unit 110 and the like and repeatedly undergoes the shape vector generation and quantization until m=M.

Figure 3:
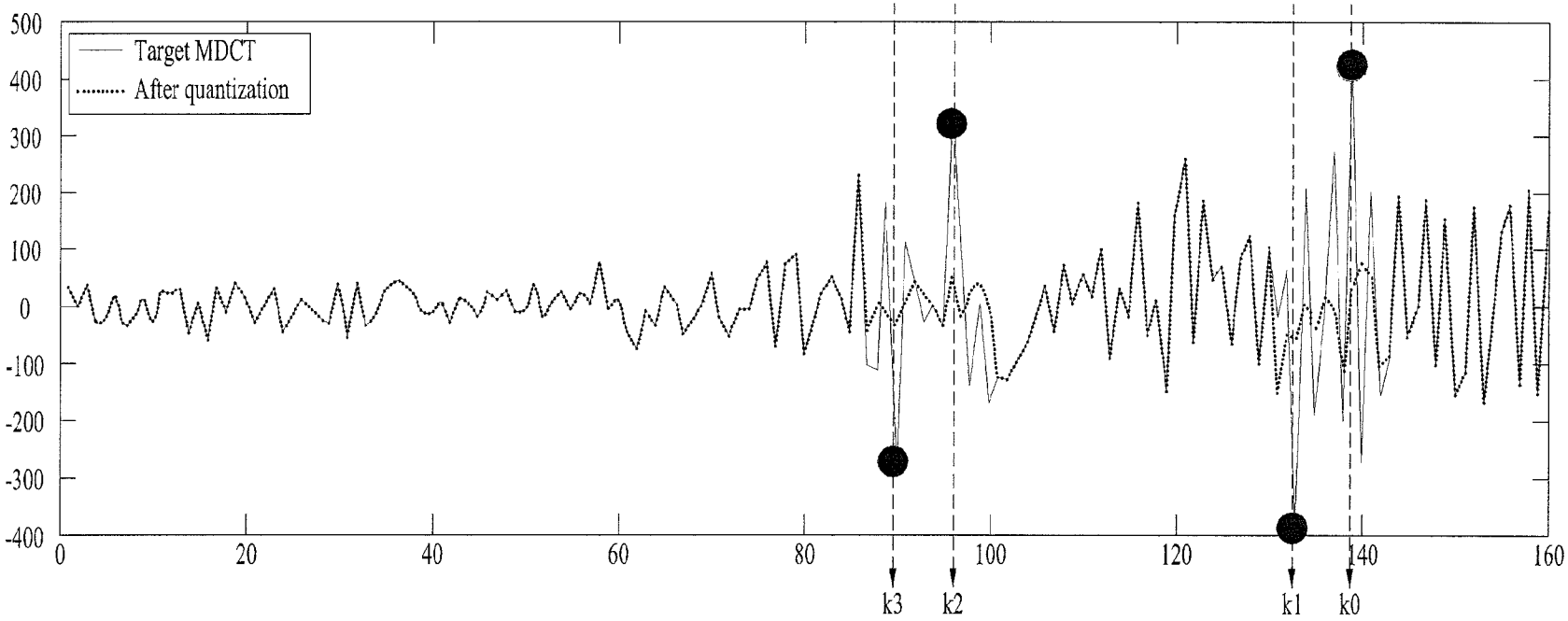
FIG. 3 is a diagram for describing a process for generating a shape vector by a multi-stage (m=0, . . . ) process.

On example of the case of 'M=4' is shown in FIG. 3. Like FIG. 2, a shape vector $S_0$ is determined centering on a $1^{st}$ stage peak ($k_0$=139) and a result from subtracting a $1^{st}$ stage shape code vector $\tilde{Y}_0$ (or a value resulting from applying a normalized value to $\tilde{Y}_0$), which is a result of vector quantization of the determined shape vector $S_0$, from an original signal $X_0$ becomes a $2^{nd}$ stage input signal $X_1$. Hence, it can be observed that a location $k_1$ of a peak having a highest energy value in the $2^{nd}$ stage input signal $X_1$ is about 133 in FIG. 2. It can be observed that a $3^{rd}$ stage peak $k_2$ is about 96 and that a $4^{th}$ stage peak $k_3$ is about 89. Thus, in case that shape vectors are extracted through the multiple stages (e.g., total 4 stages (M=4)), it may be able to extract total 4 shape vectors ($S_0$, $S_1$, $S_2$, $S_3$).

Meanwhile, in order to raise compression efficiency of normalized values (G=[$G_0$, $G_1$, . . . , $G_{M-1}$], $G_m$, m=0~M−1) generated per stage (m=0~M−1), the normalized value encoding unit 150 performs vector quantization on a differential vector Gd resulting from subtracting a mean ($G_{mean}$) from each of the normalized values. First of all, the mean for the normalized values can be determined as follows.

$$G_{mean}=avg(G_0,\sim,G_{M-1}) \quad \text{[Formula 8]}$$

In Formula 8, $G_{mean}$, indicates a mean value, AVG( ) indicates an average function, and $G_0$, ~$G_{M-1}$ indicate normalized values per stage ($G_m$, m=0~M−1), respectively.

The normalized value encoding unit 150 performs vector quantization on a differential vector Gd resulting from subtracting a mean from each of the normalized values Gm. In particular, by searching a codebook, a code vector most similar to a differential value is determined as a normalized value differential code vector $\tilde{G}d$ and a codebook index for the $\tilde{G}d$ is determined as a normalized value index Gi.

FIG. 6 is a diagram for a relation between the total bit number of a normalized value differential code vector and a signal to noise ratio (SNR). IN particular, FIG. 6 shows a result of measuring a signal to noise ratio (SNR) by varying the total bit number for the normalized value differential code vector $\tilde{G}d$. In this case, the total bit number of the mean $G_{mean}$ is fixed to 5 bits. Referring to FIG. 6, even if the total bit number of the normalized value differential code vector is increased, it can be observed that the SNR almost has no increase. In particular, the number of bits used for the normalized value differential code vector has no considerable influence on the SNR. Yet, when the bit numbers of a shape code vector (i.e., a quantized shape vector) are 3 bits, 4 bits and 5 bits, respectively, if SNRs of the normalized value differential code vectors are compared to each other, it can be observed that there exist considerable differences. In particular, the SNR of the normalized value differential code vector has considerable correlation with the total bit number of the shape code vector.

Consequently, although the SNR of the normalized value differential code vector is nearly independent from the total bit number of the normalized value differential code vector, it can be observed that the SNR of the normalized value differential code vector is dependent on the total bit number of the shape code vector.

The normalized value differential code vector $\tilde{G}d$, which is generated from the normalized value encoding unit 150, and the mean $G_{mean}$ are delivered to the residual generating unit 160 and the normalized value mean $G_{mean}$ and the normalized value index $G_i$ are delivered to the multiplexing unit 180.

The residual generating unit 160 receives the normalized value differential code vector $\tilde{G}d$, the mean $G_{mean}$, the input signal $X_0$ and the shape code vector $\tilde{Y}_m$ and then generates a normalized value code vector $\tilde{G}$ by adding the mean to the normalized value differential code vector. Subsequently, the residual generating unit 160 generates a residual z, which is a coding error or quantization error of the shape vector coding, as follows.

$$Z=Xo-\tilde{G}_0\tilde{Y}_0-\ldots-\tilde{G}_{M-1}\tilde{Y}_{M-1} \quad \text{[Formula 9]}$$

In Formula 9, z indicates a residual, $X_0$ indicates an input signal (of a 1$^{st}$ stage), $\tilde{Y}_m$ indicates a shape code vector, and $\tilde{G}_m$ indicates an (m+1)th element of a normalized value code vector $\tilde{G}$.

The residual encoding unit 170 applies a frequency envelope coding scheme to the residual z. A parameter for the frequency envelope may be defined as follows.

$$F_e(i)=\frac{1}{2}\log_2\left(\frac{1}{2W}\sum_{k=W_i}^{W(i+2)-1}(w_f(k)z(k))^2\right), \quad 0\le i<160/W \quad \text{[Formula 10]}$$

In Formula 10, $F_e$(i) indicates a frequency envelope, i indicates an envelope parameter index, $w_f$(k) indicates 2W-dimensional Hanning window, and z(k) indicates a spectral coefficient of a residual signal.

In particular, by performing 50% overlap windowing, a log energy corresponding to each window is defined as a frequency envelope to use.

For instance, when W=8, according to Formula 10, since i=0~19, it is able to transmit total 20 envelope parameters ($F_e$(i)) by a split vector quantization scheme. In doing so, vector quantization is performed on a mean removed part for quantization efficiency. The following formula represents vectors resulting from subtracting a mean energy value from split vectors.

$$F_0^M=F_0-M_F\,F_0=[F_e(0),\ldots,F_e(4)],$$

$$F_1^M=F_1-M_F\,F_1=[F_e(5),\ldots,F_e(9)],$$

$$F_2^M=F_2-M_F\,F_2=[F_e(10),\ldots,F_e(14)],$$

$$F_3^M=F_3-M_F\,F_3=[F_e(15),\ldots,F_e(19)]. \quad \text{[Formula 11]}$$

In Formula 11, Fe(i) indicates a frequency envelope parameter (i=0~19, W=8), $F_j$ (j=0, . . . ) indicate split vectors, $M_F$ indicates a mean energy value, and $F_j^M$(j=0, . . . ) indicates mean removed split vectors.

The residual encoding unit 170 performs vector quantization on the mean removed split vectors ($F_j^M$(j=0, . . . )) through a codebook search, thereby generating an envelope parameter index $F_{ji}$. And, the residual encoding unit 170 delivers the envelope parameter index $F_{ji}$ and the mean energy $M_E$ to the multiplexing unit 180.

The multiplexing unit 180 multiplexes the data delivered from the respective components together, thereby generating at least one bitstream. In doing so, when the bitstream is generated, it may be able to follow the syntax shown in FIG. 7.

FIG. 7 is a diagram for one example of a syntax for elements included in a bitstream. Referring to FIG. 7, it is able to generate location information and sign information based on a location ($k_m$) and sign ($Sign_m$) received from the location detecting unit 110. If M=4, 7 bits (total 28 bits) may be assigned to the location information per stage (e.g., m=0 to 3) and 1 bit (total 4 bits) may be assigned to the sign information per stage (e.g., m=0 to 3), by which the present invention may be non-limited (i.e., the present invention is non-limited by specific bit number). And, it may be able to assign 3 bits (total 12 bits) to a codebook index $Y_{mi}$, of a shape vector per stage as well. A normalized mean $G_{mean}$ and a normalized value index $G_i$ are the values generated not for each stage but for the whole stages. In particular, 5 bits and 6 bits may be assigned to the normalized mean $G_{mean}$ and the normalized value index $G_i$, respectively.

Meanwhile, when the envelope parameter index $F_{ji}$ indicates total 4 split factors (i.e., j=0, . . . , 3), if 5 bits are assigned to each split vector, it may be able to assign total 20 bits. Meanwhile, if the whole mean energy $M_F$ is exactly quantized without being split, it may be able to assign total 5 bits.

Figure 8:
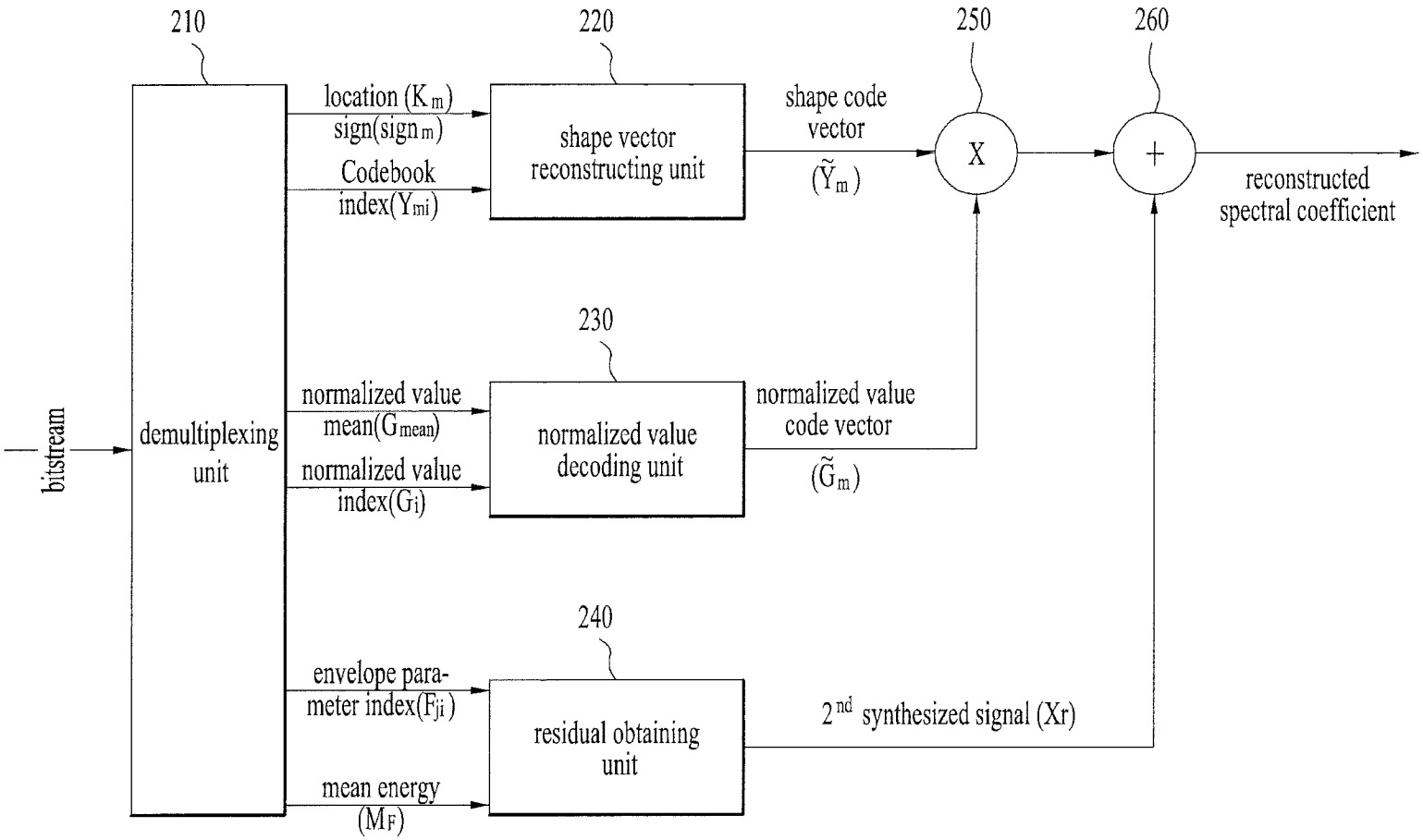
FIG. 8 is a diagram for configuration of a decoder in an audio signal processing apparatus according to one embodiment of the present invention.

FIG. 8 is a diagram for configuration of a decoder in an audio signal processing apparatus according to one embodiment of the present invention. Referring to FIG. 8, a decoder 200 includes a shape vector reconstructing unit 220 and may further include a demultiplexing unit 210, a normalized value decoding unit 230, a residual obtaining unit 240, a $1^{st}$ synthesizing unit 250 and a $2^{nd}$ synthesizing unit 260.

The demultiplexing unit 210 extracts such elements shown in the drawing as location information $k_m$ and the like from at least one bitstream received from an encoder and then delivers the extracted elements to the respective components.

The shape vector reconstructing unit receives a location ($k_m$), a sign ($Sign_m$) and a codebook index ($Y_{mi}$). The shape vector reconstructing unit 220 obtains a shape code vector corresponding to the codebook index from a codebook by performing de-quantization. The shape vector reconstructing unit 220 enables the obtained code vector to be situated at the location $k_m$ and then applies the sign thereto, thereby reconstructing a shape code vector $\tilde{Y}_m$. Having reconstructed the shape code vector, the shape vector reconstructing unit 220 enables the rest of right and left parts (N−2L), which do not match dimension(s) of the signal X, to be padded with zeros.

Meanwhile, the normalized value decoding unit 230 reconstructs a normalized value differential code vector $\tilde{G}d$ corresponding to the normalized value index G1 using the codebook. Subsequently, the normalized value decoding unit 230 generates a normalized value code vector $\tilde{G}_m$ by adding a normalized value mean $G_{mean}$ to the normalized value code vector.

The $1^{st}$ synthesizing unit 250 reconstructs a $1^{st}$ synthesized signal Xp as follows.

$$Xp=\tilde{G}_0\tilde{Y}_0+\tilde{G}_1\tilde{Y}_1+\ldots+\tilde{G}_{M-1}\tilde{Y}_{M-1} \quad \text{[Formula 12]}$$

The residual obtaining unit 240 reconstructs an envelope parameter $F_e(i)$ in a manner of receiving an envelope parameter index $F_{ji}$ and a mean energy $M_F$, obtaining mean removed split code vectors $F_j^M$ corresponding to the envelope parameter index ($F_{ji}$), combining the obtained split code vectors, and then adding the mean energy to the combination.

Subsequently, if a random signal having a unit energy is generated from a random signal generator (not shown in the drawing), a $2^{nd}$ synthesized signal is generated in a manner of multiplying the random signal by the envelope parameter.

Yet, in order to reduce a noise occurring effect caused by the random signal, the envelope parameter may be adjusted as follows before being applied to the random signal.

$$\tilde{F}_e(i)=\alpha\cdot F_e(i) \quad \text{[Formula 13]}$$

In Formula 13, Fe(i) indicates an envelope parameter, a indicates a constant, and $\tilde{F}_e(i)$ indicates an adjusted envelope parameter.

In this case, the $\alpha$ may include a constant value by text. Alternatively, it may be able to apply an adaptive algorithm that reflects signal properties.

The $2^{nd}$ synthesized signal Xr, which is a decoded envelope parameter, is generated as follows.

$$Xr=\text{random}(\ )\times\tilde{F}_e(i) \quad \text{[Formula 14]}$$

In Formula 14, random( ) indicates a random signal generator and $\tilde{F}_e(i)$ indicates an adjusted envelope parameter.

Since the above-generated $2^{nd}$ synthesized signal Xr includes the values calculated for the Hanning-windowed signal in the encoding process, it may be able to maintain the conditions equivalent to those of the encoder in a manner of covering the random signal with the same window in the decoding step. Likewise, it is able to output spectral coefficient elements decoded by the 50% overlapping and adding process.

The $2^{nd}$ synthesizing unit 260 adds the $1^{st}$ synthesized signal Xp and the $2^{nd}$ synthesized signal Xr together, thereby outputting a finally reconstructed spectral coefficient.

The audio signal processing apparatus according to the present invention is available for various products to use. Theses products can be mainly grouped into a stand alone group and a portable group. A TV, a monitor, a settop box and the like can be included in the stand alone group. And, a PMP, a mobile phone, a navigation system and the like can be included in the portable group.

FIG. 9 is a schematic block diagram of a product in which an audio signal processing apparatus according to one embodiment of the present invention is implemented. Referring to FIG. 9, a wire/wireless communication unit 510 receives a bitstream via wire/wireless communication system. In particular, the wire/wireless communication unit 510 may include at least one of a wire communication unit 510A, an infrared unit 510B, a Bluetooth unit 510C and a wireless LAN unit 510D and a mobile communication unit 510E.

A user authenticating unit 520 receives an input of user information and then performs user authentication. The user authenticating unit 520 may include at least one of a fingerprint recognizing unit, an iris recognizing unit, a face recognizing unit and a voice recognizing unit. The fingerprint recognizing unit, the iris recognizing unit, the face recognizing unit and the speech recognizing unit receive fingerprint information, iris information, face contour information and voice information and then convert them into user informations, respectively. Whether each of the user informations matches pre-registered user data is determined to perform the user authentication.

An input unit 530 is an input device enabling a user to input various kinds of commands and can include at least one of a keypad unit 530A, a touchpad unit 530B, a remote controller unit 530C and a microphone unit 530D, by which the present invention is non-limited. In this case, the microphone unit 530D is an input device configured to receive an input of a speech or audio signal. In particular, each of the keypad unit 530A, the touchpad unit 530B and the remote controller unit 530C is able to receive an input of a command for an outgoing call or an input of a command for activating the microphone unit 530D. In case of receiving a command for an outgoing call via the keypad unit 530D or the like, a control unit 559 is able to control the mobile communication unit 510E to make a request for a call to the corresponding communication network.

A signal coding unit 540 performs encoding or decoding on an audio signal and/or a video signal, which is received via the wire/wireless communication unit 510, and then outputs an audio signal in time domain. The signal coding unit 540 includes an audio signal processing apparatus 545. As mentioned in the foregoing description, the audio signal processing apparatus 545 corresponds to the above-described embodiment (i.e., the encoder 100 and/or the decoder 200) of the present invention. Thus, the audio signal processing apparatus 545 and the signal coding unit including the same can be implemented by at least one or more processors.

The control unit 550 receives input signals from input devices and controls all processes of the signal decoding unit 540 and an output unit 560. In particular, the output unit 560 is a component configured to output an output signal generated by the signal decoding unit 540 and the like and may include a speaker unit 560A and a display unit 560B. If the output signal is an audio signal, it is outputted to a speaker. If the output signal is a video signal, it is outputted via a display.

Figure 10:
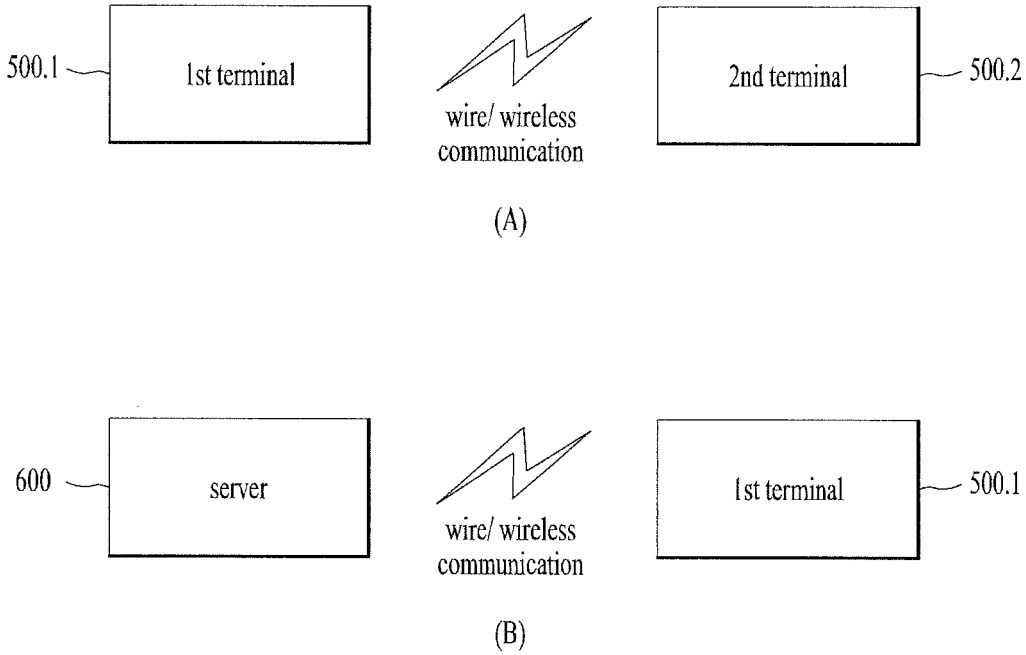
FIG. 10 is a diagram for explaining relations between products in which an audio signal processing apparatus according to one embodiment of the present invention is implemented.

FIG. 10 is a diagram for relations of products provided with an audio signal processing apparatus according to an embodiment of the present invention. FIG. 10 shows the relation between a terminal and server corresponding to the products shown in FIG. 9. Referring to FIG. 15 (A), it can be observed that a first terminal 500.1 and a second terminal 500.2 can exchange data or bitstreams bi-directionally with each other via the wire/wireless communication units. Referring to FIG. 15 (B), it can be observed that a server 600 and a first terminal 500.1 can perform wire/wireless communication with each other.

Figure 11:
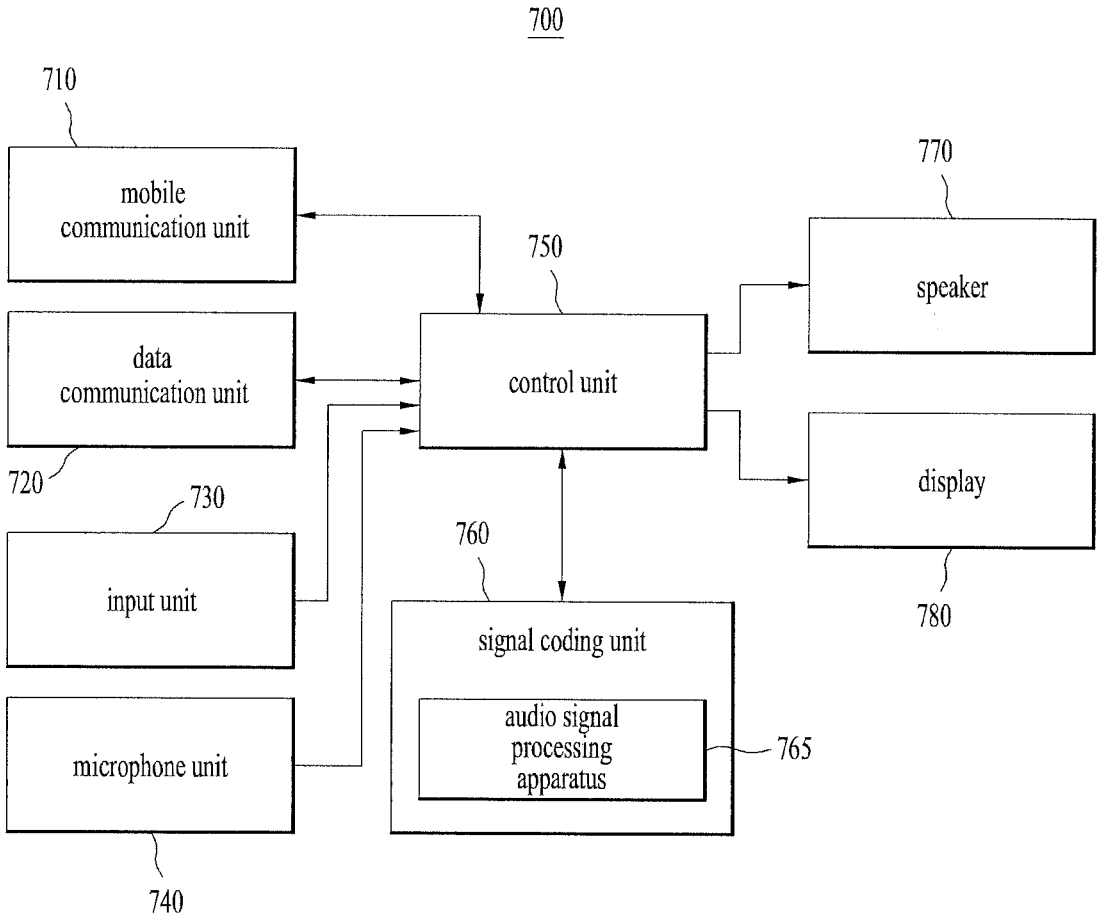
FIG. 11 is a schematic block diagram of a mobile terminal in which an audio signal processing apparatus according to one embodiment of the present invention is implemented.

FIG. 11 is a schematic block diagram of a mobile terminal in which an audio signal processing apparatus according to one embodiment of the present invention is implemented. A mobile terminal 700 may include a mobile communication unit 710 configured for incoming and outgoing calls, a data communication unit for data configured for data communication, a input unit configured to input a command for an outgoing call or a command for an audio input, a microphone unit 740 configured to input a speech or audio signal, a control unit 750 configured to control the respective components, a signal coding unit 760, a speaker 770 configured to output a speech or audio signal, and a display 780 configured to output a screen.

The signal coding unit 760 performs encoding or decoding on an audio signal and/or a video signal received via one of the mobile communication unit 710, the data communication unit 720 and the microphone unit 530D and outputs an audio signal in time domain via one of the mobile communication unit 710, the data communication unit 720 and the speaker 770. The signal coding unit 760 includes an audio signal processing apparatus 765. As mentioned in the foregoing description of the embodiment (i.e., the encoder 100 and/or the decoder 200 according to the embodiment) of the present invention, the audio signal processing apparatus 765 and the signal coding unit including the same may be implemented with at least one processor.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above mentioned encoding method can be stored in the computer-readable recording medium or can be transmitted via wire/wireless communication network.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

Accordingly, the present invention is applicable to encoding and decoding an audio signal.

What is claimed is:

1. A method of processing an audio signal, comprising:

receiving, by a decoding apparatus, an input audio signal corresponding to a plurality of spectral coefficients;

obtaining, by the decoding apparatus, location information indicating a location of a specific one of a plurality of the spectral coefficients based on an energy of the input signal;

generating, by the decoding apparatus, a shape vector using the location information and the spectral coefficients, wherein the shape vector is generated using a part selected from the spectral coefficients and wherein the selected part is selected based on the location information;

generating, by the decoding apparatus, a normalized value for the selected part;

determining, by the decoding apparatus, a codebook index by searching a codebook corresponding to the shape vector, wherein determining the codebook index comprises generating a normalized shape vector by normalizing the shape vector using the normalized value and determining the codebook index by searching the codebook corresponding to the normalized shape vector;

calculating, by the decoding apparatus, a mean of $1^{st}$ to $M^{th}$ stage normalized values;

generating, by the decoding apparatus, a differential vector using a value resulting from subtracting the mean from the $1^{st}$ to $M^{th}$ stage normalized values;

determining, by the decoding apparatus, the normalized value index by searching the codebook corresponding to the differential vector;

transmitting, by the decoding apparatus, the codebook index and the location information; and transmitting, by the decoding apparatus, the mean and the normalized value index corresponding to the normalized value.

2. The method of claim 1, further comprising:

generating, by the decoding apparatus, sign information on the specific spectral coefficient; and transmitting the sign information, wherein the shape vector is generated further based on the sign information.

3. The method of claim 1, wherein the input audio signal comprises an $(m+1)^{th}$ stage input signal, the shape vector comprises an $(m+1)^{th}$ stage shape vector, and the normalized value comprises an $(m+1)^{th}$ stage normalized value, and wherein the $(m+1)^{th}$ stage input signal is generated based on an $m^{th}$ stage input signal, an $m^{th}$ stage shape vector and an $m^{th}$ stage normalized value.

4. The method of claim 1, determining the codebook index comprises:

searching, by the decoding apparatus, the codebook using a cost function including a weight factor and the shape vector; and determining, by the decoding apparatus, the codebook index corresponding to the shape vector, wherein the weight factor varies in accordance with the selected part.

5. The method of claim 1, further comprising:

generating, by the decoding apparatus, a residual signal using the input audio signal and a shape code vector corresponding to the codebook index; and generating, by the decoding apparatus, an envelope parameter index by performing a frequency envelope coding on the residual signal.

6. An apparatus for processing an audio signal, comprising:

a location detecting unit configured to receive an input audio signal corresponding to a plurality of spectral coefficients, the location detecting unit being configured to obtain location information indicating a location of a specific one of a plurality of the spectral coefficients based on an energy of the input signal;

a shape vector generating unit configured to generate a shape vector using the location information and the spectral coefficients, wherein the shape vector is generated using a part selected from the spectral coefficients, wherein the selected part is selected based on the location information, and wherein the shape vector generating unit is configured to generate a normalized value for the selected part and generate a normalized shape vector by normalizing the shape vector using the normalized value;

a vector quantizing unit configured to determine a codebook index by searching a codebook corresponding to the shape vector, the vector quantizing unit being configured to determine the codebook index by searching the codebook corresponding to the normalized shape vector;

a multiplexing unit configured to transmit the codebook index and the location information; and a normalized value encoding unit configured to calculate a mean of $1^{st}$ to $M^{th}$ stage normalized values, generate a differential vector using a value resulting from subtracting the mean from the $1^{st}$ to $M^{th}$ stage normalized values, determine the normalized value index by searching the codebook corresponding to the differential vector, and transmit the mean and the normalized index corresponding to the normalized value.

7. The apparatus of claim 6, wherein the location detecting unit is configured to generate sign information on the specific spectral coefficient, wherein the multiplexing unit is configured to transmit the sign information, and wherein the shape vector is generated further based on the sign information.

8. The apparatus of claim 6, wherein the input audio signal comprises an $(m+1)^{th}$ stage input signal, the shape vector comprises an $(m+1)^{th}$ stage shape vector, and the normalized value comprises an $(m+1)^{th}$ stage normalized value, and wherein the $(m+1)^{th}$ stage input signal is generated based on an $m^{th}$ stage input signal, an $m^{th}$ stage shape vector and an $m^{th}$ stage normalized value.

9. The apparatus of claim 6, wherein the vector quantizing unit is configured to search the codebook using a cost function including a weight factor and the shape vector and determine the codebook index corresponding to the shape vector and wherein the weight factor varies in accordance with the selected part.

10. The apparatus of claim 6, further comprising a residual encoding unit is configured to generate a residual signal using the input audio signal and a shape code vector corresponding to the codebook index, the residual encoding unit being configured to generate an envelope parameter index by performing a frequency envelope coding on the residual signal.

* * * * *